United States Patent [19]

Serra

[11] 4,080,132

[45] Mar. 21, 1978

[54] ADJUSTABLE TWO PIECE PLUNGER

[76] Inventor: Lawrence Serra, 1536 E. Cold Spring La., Baltimore, Md. 21218

[21] Appl. No.: 650,959

[22] Filed: Jan. 21, 1976

[51] Int. Cl.[2] ..... B28B 13/04

[52] U.S. Cl. ..... 425/168; 425/443; 425/444

[58] Field of Search ..... 425/168, 422, 424, 443–444, 425/457, 469

[56] References Cited

U.S. PATENT DOCUMENTS

| | | | |
|---|---|---|---|
| 955,063 | 4/1910 | Fisher | 425/469 |
| 2,594,760 | 4/1952 | Flam | 425/424 |
| 2,757,430 | 8/1956 | Sipe | 425/422 |
| 2,887,755 | 5/1959 | Zevely | 425/444 |
| 2,932,876 | 4/1960 | Zevely | 425/444 |
| 2,985,935 | 5/1961 | Wellnitz | 425/444 |

*Primary Examiner*—Francis S. Husar
*Assistant Examiner*—John McQuade

[57] ABSTRACT

A block molding machine for manufacturing concrete blocks, the machine including a stripper head, which includes a head plate upon the underside of which there are adjustably supported several plungers, for forming the central openings through a conventional concrete block, each plunger consisting of two bars, that can be adjustably spread apart, as wished, in order to compensate for wear on the outer sides thereof.

1 Claim, 5 Drawing Figures

ADJUSTABLE TWO PIECE PLUNGER

This invention relates generally to concrete block molding machinery.

It is generally well known to those who are skilled in the manufacture of concrete buidling blocks, that a standard stripper head, of a conventional building block molding machine, consists of a plate, to which several plungers are attached, each plunger consisting of a pair of bars rigidly welded to a plunger plate that is bolted to the head plate, so that there is no adjustment to an over-all width of the plunger, so to compensate for the wear on the opposite walls thereof. It is desired that the top edges of the concrete block are made sharp, so that there should be a relatively minimal difference between the dimension across the width of the plunger components, and the dimension between the opposite side walls of the mold. However, due to wear and bending of a rigid plunger thus formed, the difference between these dimensions gradually increases so, that the top edge of the concrete block is no longer made sharp. This situation is, of course, objectionable, and is therefore in want of an improvement.

Accordingly it is the principal object of the present invention to provide an adjustable two piece plunger, for incorporating in a stripper head of a block making machine mold, so that the dimensional width across the plunger can be adjusted to the width between the mold walls.

Another object of the present invention is to provide an adjustable two piece plunger, wherein the plunger components are individually adjustable on the head plate, by means of adjusting screws.

Other objects of the present invention are to provide an adjustable two piece plunger which is simple in design, inexpensive to manufacture, rugged in construction, easy to use and efficient in operation.

These and other objects will be readily evident upon a study of the following specification and the accompanying drawing wherein.

Figure 1:
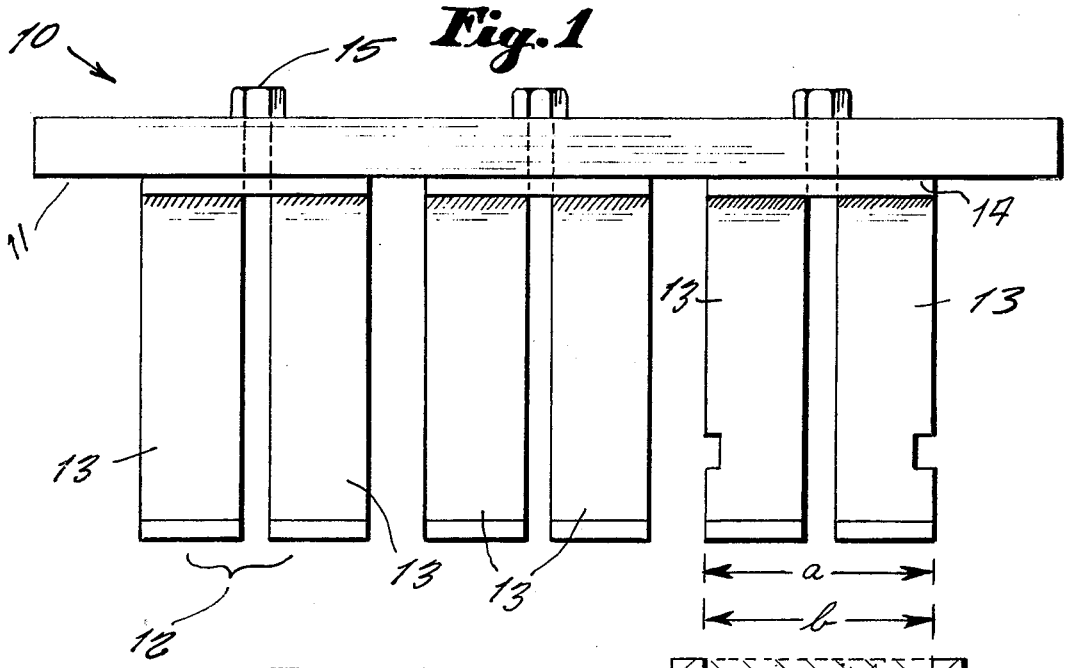
FIG. 1 is a side elevation view of a stripper head, and casting plungers secured thereto, as is conventionally now being used.
Figure 2:
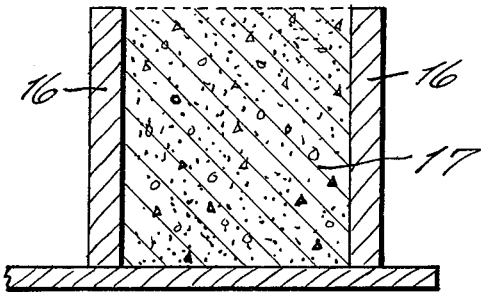
FIG. 2 is a cross-sectional view of a corresponding mold, that is conventionally now being used therewith.

Referring now to the drawing in greater detail, the reference numeral 10 represents a prior existing art, of a standard stripper head of a block molding machine, and which serves to compact and form the upper part of a concrete building block. The standard stripper head 10 includes a head plate 11, having several plungers 12 secured thereto, each plunger 12 consisting of a pair of bar components 13, which are welded at the upper ends to a plunger plate 14, and which is secured to the head plate by means of a bolt means 15. It is now evident that there is no adjustability provided for changing a dimension "*a*," which defines the overall width of the plunger as shown in FIG. 1. In an ideal state, the dimension "*a*" is minimally smaller than a dimension "*b*" shown in FIG. 2, and which defines the width between opposite side walls 16 into which concrete 17 is placed for the manufacture of a concrete building block.

It is well known, however, that, in time, the plunger 12 may become bent from use, and additionally will wear, so that a greater difference will develop between the dimensions "*a*" and "*b*." This is, of course, objectionable, because the upper edges of the concrete block will thus no longer be sharp.

Figure 5:
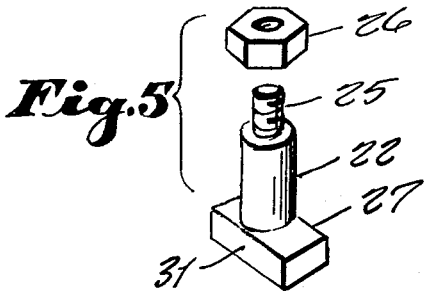
FIG. 5 is a perspective view of a fixed bolt unit positioned between the plunger bars.
Figure 3:
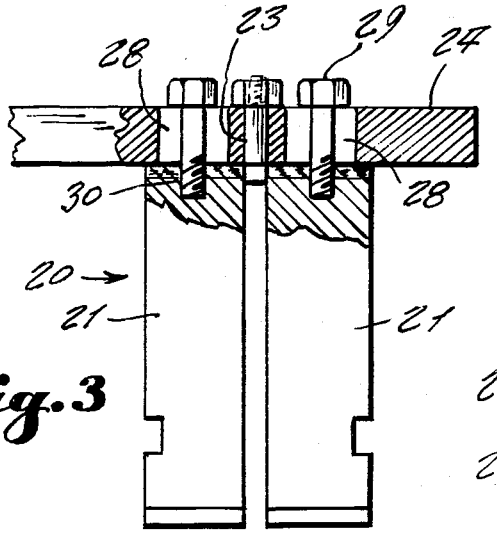
FIG. 3 is a side view shown partly in cross section, and illustrating the present invention, and showing a plunger adjustably supported to a stripper head.
Figure 4:
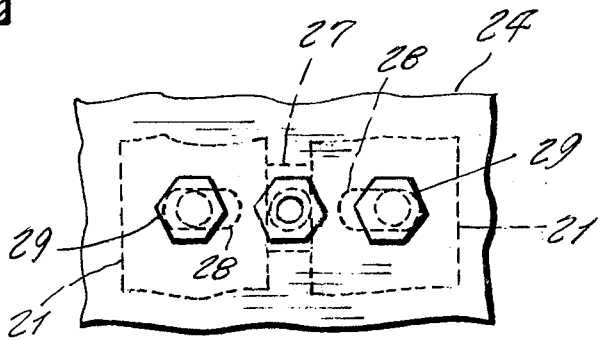
FIG. 4 is a top view thereof.

Accordingly in the present invention, as shown in FIGS. 3, 4 and 5, an adjustable two piece plunger 20 is provided, and which consists of two bar components 21, that are adjustable relative to each other, in order to compensate for wear and possible binding that may occur.

As shown in the drawing, a fixed bolt 22 is inserted through an opening 23 formed in a head plate 24, the upper end of the bolt having a threaded portion 25 receiving a nut 26. A lower end of the bolt includes cross arm 27, for being positioned adjacent to underside of the head plate.

Elongated slots 28 on opposite sides of the opening 23 in the head plate each receives a bolt 29, which at its lower end is threadingly engaged within threaded opening 30, within an upper end of each of the bar components 21.

It is now evident that, in use, the bar components 21 may be each brought closer together by bearing against opposite sides 31 of the cross arm 27, as shown in FIG. 3. In time, as the plunger components wear, so that the overall width thereacross become smaller, the bolts 29 may become loosened, and each component 21 can then be shifted slightly away from the cross arms, by means of the bolts 29 sliding in the slots 28. Thus the plungers can be made to maintain a constant overall width over a relatively long period of time.

While various changes may be made in the detail construction, it is understood that such changes will be within the spirit and scope of the present invention as is defined by the appended claims.

I claim:

1. A concrete block molding machine for molding a conventional concrete block, comprising, in combination, a stripper head and a mold, said stripper head including a plurality of plungers positioned to be received in said mold, said stripper head having a head plate, a plurality of elongated slots through said head plate, said slots being grouped in pairs, the longitudinal axis of each said slot of each pair of slots being parallel to each other, a fixed bolt opening positioned between each pair of slots, said fixed bolt openings extending through said head plate, each said plunger being adjustable in over-all width, so as to compensate for wear and handling thereof, each said plunger being comprised of a pair of bar units, each said bar unit having a threaded opening in an upper end thereof, each said plunger being positioned adjacent an underside of said head plate, each said threaded opening receiving a bolt extending through one of said elongated slots, and having a bolt head positioned adjacent the upperside of said head plate, for rigid securement of said bar units to said head plate and for maintaining a selected said adjustable over-all width of each plunger; a fixed bolt received through each said fixed bolt opening, each fixed bolt comprising a cylindrical shank, which, at one end, is integral with a cross-arm, an opposite end of said fixed bolt shank having a screw thread, each said fixed bolt cross-arm being positioned adjacent said underside of said head plate, and located between the bar units of a plunger for abutment therewith, each fixed bolt shank extending upwardly through a fixed bolt opening, and a nut adjacent said head plate upperside engaging each screw-threaded end of each shank for rigid securement of each fixed bolt to said head plate.

* * * * *